United States Patent [19]

Eiermann

[11] 4,080,120

[45] Mar. 21, 1978

[54] INNER SEAL FOR ROTARY PISTON ENGINES AND METHOD OF MAKING SAME

[75] Inventor: Dankwart Eiermann, Lindau, Germany

[73] Assignee: Wankel GmbH, Germany

[21] Appl. No.: 739,113

[22] Filed: Nov. 5, 1976

[30] Foreign Application Priority Data

Nov. 13, 1975 Germany ..... 2550889

[51] Int. Cl.[2] ..... F01C 19/00; F04C 15/00; F04C 27/00

[52] U.S. Cl. ..... 418/142; 418/81 P

[58] Field of Search ..... 418/142, 152, 91; 277/81, 82, 81 P, 86, 88, 96

[56] References Cited

U.S. PATENT DOCUMENTS

| | | | |
|---|---|---|---|
| 3,816,041 | 6/1974 | Eierman | 418/142 |
| 3,884,602 | 5/1975 | Phillips | 418/142 |
| 3,909,015 | 9/1975 | Kasahara | 418/142 |

*Primary Examiner*—Robert I. Smith
*Attorney, Agent, or Firm*—Walter Becker

[57] ABSTRACT

An inner or end seal ring for a rotary piston engine and a method of making the seal ring in which an annular sheet metal strip is formed to a U-shape which opens in the axial direction, while an insert ring having radially disposed axially extending partition elements thereon is placed in the seal ring. The radially inner leg of the seal ring inclines inwardly toward the central axis of the seal ring and the axially outer portion of the radially outer leg of the seal ring also inclines inwardly and holds the insert ring and partition elements thereon captive in the seal ring. The outer ends of the seal ring legs and of the partition elements are co-planar.

5 Claims, 3 Drawing Figures

INNER SEAL FOR ROTARY PISTON ENGINES AND METHOD OF MAKING SAME

The present invention relates to an inner seal for rotary piston engines which is arranged at the end face of a piston of a rotary piston engine, which piston rotates on an eccentric. This inner seal has a base body which in axial cross section is U-shaped and the legs of which form two sealing rings which with their end faces acting as sealing surfaces slide along the adjacent side wall while being pressed thereaginst by spring means. In this side wall there is provided a bore which is coaxial with the eccentric shaft and which has such a diameter that during the rotation of the piston it is located radially inwardly of the outer sealing surface while the inner sealing surface slides thereover. It has been suggested heretofore to form between the sealing rings of the base body, by means of webs radially interconnecting the sealing rings, chambers which are open toward the adjacent side wall, and to provide the sealing rings with an angle of incidence of 60° directed radially inwardy and toward the side wall.

This suggestion has the drawback that the manufacture of the chambers by milling or casting or by other deforming techniques is too expensive. This is in particular due to the fact that the radially inwardly pointing outer sealing rings make undercuts necessary. Furthermore, the webs separating the chambers, in view of the necessary roundings on the corner connections, represent large bearing or contacting areas on the side wall. As a result thereof, when using such a seal over a longer period of time, there occurs less wear on these bearing surfaces than on the sealing rings which latter expediently should have only a very narrow bearing surface of from 0.05 to 0.8 mm. Due to this greater wear at the contact surfaces of the sealing rings there will occur leakage.

It is, therefore, an object of the present invention to provide a seal which will overcome the above mentioned drawbacks and will permit a simpler and less expensive manufacturing process than could heretofore be realized.

This object and other objects and advantages of the invention will appear more clearly from the following specification in connection with the accompanying drawing, in which.

Figure 1:
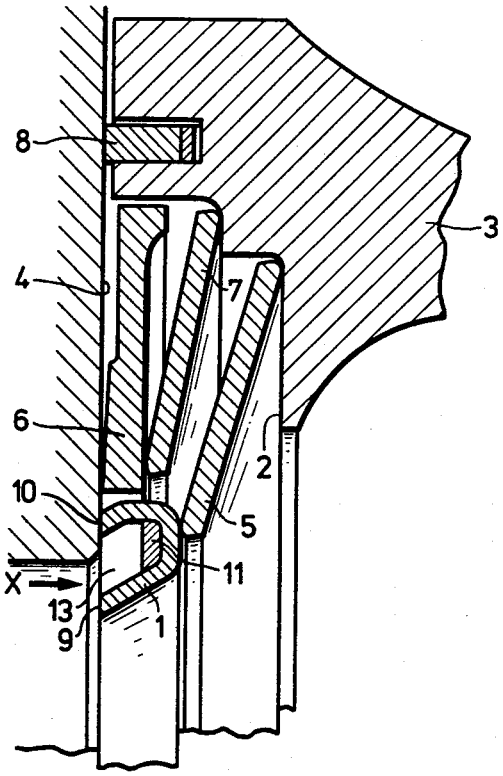
FIG. 1 represents a partial radial section through a rotary piston engine and also shows the inner seal according to the invention.

The problem underlying the present invention has been solved by providing the inner seal according to the invention with a sheet metal ring which is bent to form a U-shaped cross section. This sheet metal ring has a radially extending inner leg which forms an inner sealing ring with an angle of incidence of 60° with regard to the side wall of the housing, and this sheet metal ring has also a radially extending outer leg which forms an outer sealing ring and the first part of which forms an angle of incidence of approximately 90° with regard to the side wall of the housing while its outer third part forms an angle of incidence of 60° with regard to the side wall of the housing. At the bottom of the sheet metal ring there is provided an annular insert member which comprises chamber separating webs, while the radial side surfaces of these chamber separating webs engage the inner surface of the sheet metal ring over the entire height of the inner and of the outer sealing ring in a sealing manner.

For manufacturing the inner seal according to the present invention it is suggested that an annular sheet metal strip is drawn in a pressing tool to form a sheet metal ring with U-shaped radial cross section and with an inner leg pointing inwardly at an angle of 60° to the radial plane of the sheet metal ring and with a second leg drawn in a direction perpendicular to the radial plane of the sheet metal ring. Thereupon the insert member is placed into the sheet metal ring and, by means of a further annular pressing tool having a forming or shaping surface which is parallel to the inner leg, the outer third of the outer leg is bent to its angle of incidence of 60° whereby a sheet metal ring is obtained which firmly surrounds the insert member.

The sealing ring of an inner seal produced according to the method of the invention in a simple and inexpensive manner in mass production will also when used for a longer period of time retain uniformly and completely engaging sealing surfaces. Inasmuch as the abutting surfaces of the chamber separating webs can be very narrow and inasmuch as between the sealing rings and the chamber separating webs no roundings are necessary any longer, the drawback has been avoided that the sealing rings are subjected to a faster wear than the engaging surfaces of the chamber separating webs.

Referring now to the drawing in detail, the inner seal according to the invention comprises a sheet metal ring 1 which is U-shaped in radial cross section and which is arranged in a recess 2 provided in the end face of the piston 3. The sheet metal ring 1 rotates on the side wall 4 of the housing while being pressed thereagainst by a dish spring 5 resting against the recess 2 in piston 3. The inner seal furthermore comprises a slide ring 6 which in its turn is by means of another dish spring 7 pressed against the housing wall 4. The reference numeral 8 designates a sealing strip which brings about the gas seal and pertains to the outer sealing system.

The sheet metal ring 1 with its legs having a wall thickness of from about 0.5 to 0.8 mm forms an inner sealing ring 9 and an outer sealing ring 10. Both sealing rings 9 and 10 have a radially inwardly pointing angle of incidence of about 60° with regard to the side wall 4 of the housing. The outer sealing ring 10 in its first portion forms an angle of 90° with regard to the side wall 4 and then in its outer third portion is bent radially inwardly to form the previously mentioned angle of incidence of 60°. With this inwardly bent portion the outer sealing ring 10 encloses an annular insert member 11 of die cast aluminum. The insert member 11 comprises the chamber separating webs 13 creating the chambers 12. The radial side surfaces of the webs 13 are precisely and in a sealing manner adapted to the inner shape of the sheet metal ring 1 and about the sealing rings 9 and 10 at a right angle. This insert member 11 engages the side wall merely with the end faces of the chamber separating webs 13 and has the only purpose to create the chambers 12 and to seal them relative to each other. The insert member 11 may, for instance, also be designed as a pressed part of sheet metal.

Figure 3:
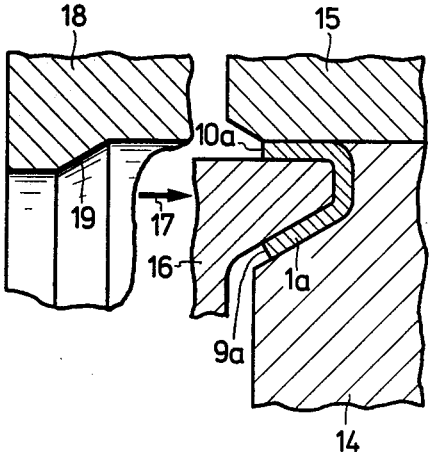
FIG. 3 is a radial section through a tool for producing the inner seal according to the invention as shown in FIG. 1.
Figure 2:
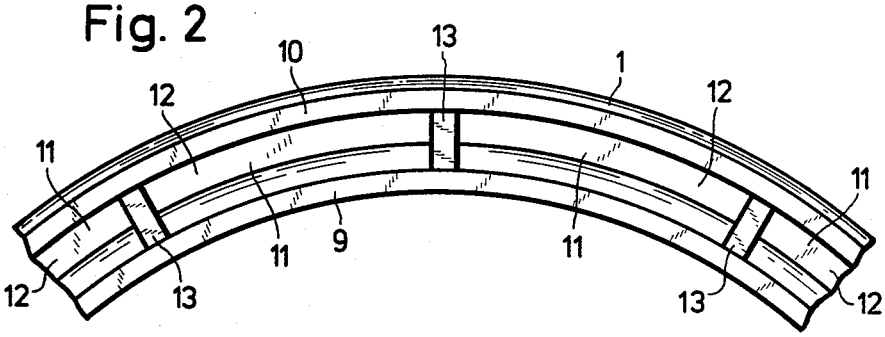
FIG. 2 is a cutout of the inner seal of FIG. 1 as seen in axial view in the direction of the arrow X.

The inner seal according to the invention may be produced in a simple and inexpensive manner according to the following method. As illustrated in FIG. 3, an annular sheet metal strip is drawn into the shape of sheet metal ring 1*a* by pressing the inner mold 16 in the direction of the arrow 17 into the outer mold consisting of two parts 14 and 15. The thus created sheet metal ring 1*a* has in inwardly located leg forming the inner sealing ring 9 forming an angle of incidence of about 60° with regard to the radial plane of the sheet metal ring 1*a*, and also has an outer leg forming the outer sealing ring 10 in the course of a later manufacturing step. Following the above described manufacturing step, the leg, which later forms the outer sealing ring 10, has an angle of incidence with regard to the radial plane of the sheet metal ring 1*a* of 90°. Into the thus formed sheet metal ring 1*a* there is now inserted the insert member 11. Thereupon the outer leg, which is to be shaped into the outer sealing ring 10 and which up to now extends at a 90° angle to the radial plane of the sheet metal ring 1*a*, is by pressing on an annular tool 18 with an inner surface 19, which is inclined to the radial plane of the sheet metal ring 1*a* by 60° , bent inwardly at its outer third portion and is shapted to form its angle of incidence of 60°. In this way a sheet metal ring is obtained which firmly surrounds the insert member 11 inserted thereinto.

It is, of course, to be understood that the present invention is, by no means, limited to the specific showing in the drawing but also comprises any modifications within the scope of the appended claims.

What is claimed is:

1. In an engine having a housing with a cavity and a piston mounted on an eccentric shaft for rotary and orbital movement in the cavity, a seal ring adapted to be interposed between the end face of the piston and the adjacent housing end wall and comprising; a U-shaped annular body opening outwardly away from the piston and having radially spaced legs and a bottom wall, the free ends of the legs of the annular body adapted for slidingly and sealingly engaging the opposed housing end wall, spring means urging the annular body toward the housing end wall, a bore in the housing end wall coaxial with the eccentric shaft and of such a diameter that the outer one only of the legs of said body is always radially outside the bore, circumferentially spaced partitions in the seal ring dividing the space between the legs thereof into chambers opening toward the housing end wall, each leg having an outer end region which makes an included angle with the housing end wall of about 60°, an insert element in said annular body resting on the bottom wall thereof and having the chamber forming partition affixed thereto and extending axially therefrom to free ends which are coplanar with the free ends of the legs and which extend from one said leg to the other.

2. The apparatus according to claim 1 in which the radially outer one of said legs has a portion adjacent the bottom wall of said annular body which is perpendicular to the plane of the housing end wall.

3. The apparatus according to claim 1 in which the radially outer one of said legs has a portion adjacent the bottom wall of said annular body which is perpendicular to the plane of the housing end wall, said portion of said leg comprising about two-thirds of the length thereof.

4. The apparatus according to claim 1 in which said seal ring is formed of sheet metal.

5. The apparatus according to claim 1 wherein the leg of said U-shaped annular body forms an outer sealing ring and is bent inwardly after insertion of the insert element.

* * * * *

UNITED STATES PATENT OFFICE

CERTIFICATE OF CORRECTION

Patent No. 4,080,120 Dated Mar. 21, 1978

Inventor(s) Dankwart Eiermann

It is certified that error appears in the above-identified patent and that said Letters Patent are hereby corrected as shown below:

[73] Assignee: Wankel GmbH, Berlin, Germany

Signed and Sealed this

*First* Day of *August 1978*

[SEAL]

*Attest:*

RUTH C. MASON
*Attesting Officer*

DONALD W. BANNER
*Commissioner of Patents and Trademarks*